US012553678B2

(12) United States Patent
Gish et al.

(10) Patent No.: US 12,553,678 B2
(45) Date of Patent: Feb. 17, 2026

(54) SAFETY SWITCH FOR A CONDUCTED ELECTRICAL WEAPON

(71) Applicant: Axon Enterprise, Inc., Scottsdale, AZ (US)

(72) Inventors: Michael E. Gish, Scottsdale, AZ (US); Patrick W. Smith, Scottsdale, AZ (US); Mark J. Eastwood, Scottsdale, AZ (US); John Groff, San Francisco, CA (US); Arturo Meuniot, San Francisco, CA (US); Stuart Sonatina, El Cerrito, CA (US); Trevor Ryan, Tahoe City, CA (US); Dmitry Soyfertis, Daly City, CA (US); Michael Roberts, San Francisco, CA (US)

(73) Assignee: Axon Enterprise, Inc., Scottsdale, AZ (US)

( * ) Notice: Subject to any disclaimer, the term of this patent is extended or adjusted under 35 U.S.C. 154(b) by 329 days.

(21) Appl. No.: 17/826,333

(22) Filed: May 27, 2022

(65) Prior Publication Data

US 2023/0066624 A1 Mar. 2, 2023

Related U.S. Application Data

(60) Provisional application No. 63/194,551, filed on May 28, 2021.

(51) Int. Cl.
*F41H 13/00* (2006.01)
*F41A 17/06* (2006.01)

(52) U.S. Cl.
CPC ..... *F41A 17/06* (2013.01); *F41H 13/0025* (2013.01)

(58) Field of Classification Search
None
See application file for complete search history.

(56) References Cited

U.S. PATENT DOCUMENTS 5,103,366 A 4/1992 Battochi
5,967,304 A 10/1999 MacKay et al.
7,631,452 B1 * 12/2009 Brundula ..... F41A 17/063 361/232
10,403,124 B1 * 9/2019 Schuler ..... G01R 33/02
(Continued)

FOREIGN PATENT DOCUMENTS

CN 1818532 B 9/2010
CN 112066787 A 11/2020
(Continued)

OTHER PUBLICATIONS

Korean Intellectual Property Office, International Search Report for International Application No. PCT/US2022/031253 mailed Sep. 19, 2022.

(Continued)

*Primary Examiner* — Reginald S Tillman, Jr.
(74) *Attorney, Agent, or Firm* — Justin Powley

(57) ABSTRACT

A safety switch for a conducted electrical weapon ("CEW") may be configured to operate between at least one fixed position and at least one momentary position. In response to the safety switch being operated into the at least one momentary position, the safety switch may return to the at least one fixed position. In the fixed position, the safety switch may be configured to perform a firing mode operation. In the momentary position, the safety switch may be configured to perform a non-firing mode operation.

20 Claims, 7 Drawing Sheets

(56) References Cited

U.S. PATENT DOCUMENTS

| | | | |
|---|---|---|---|
| 10,809,040 | B2 | 10/2020 | Kim |
| 2010/0064568 | A1 | 3/2010 | NuDyke |
| 2015/0022558 | A1* | 1/2015 | Li ..... G06F 1/1694 345/650 |
| 2015/0253093 | A1 | 9/2015 | Allan |
| 2016/0069651 | A1* | 3/2016 | Gull Gazit ..... F41H 13/0018 361/232 |
| 2019/0154409 | A1 | 5/2019 | Heroor et al. |
| 2019/0301826 | A1 | 10/2019 | Werner |
| 2020/0109924 | A1 | 4/2020 | Goodchild et al. |
| 2020/0348098 | A1 | 11/2020 | Galie et al. |
| 2021/0080231 | A1 | 3/2021 | Nerheim |
| 2021/0148665 | A1 | 5/2021 | Delgado Acarreta et al. |

FOREIGN PATENT DOCUMENTS

| | | | |
|---|---|---|---|
| CN | 112066812 | A | 11/2020 |
| KR | 10-2019-0087858 | A | 7/2019 |
| TW | I667446 | B | 8/2019 |
| TW | 201937127 | A | 9/2019 |

OTHER PUBLICATIONS

Taiwan International Patent Office, Search Report for Taiwanese Application No. 111119915 completed Nov. 28, 2022.

European Patent Office, Extended European Search Report for European Application No. 22812216.4, mailed Mar. 25, 2025.

Taiwan Patent Office, Allowance Decision for Taiwanese Application No. 112140478, mailed Mar. 28, 2025.

Intellectual Property Office of Singapore, Invitation to Respond to Written Opinion, for Singapore Patent Application No. 11202309003S, mailed Dec. 24, 2025.

IP Australia, Examination Report No. 2 for Australian Patent Application No. 2022280077, mailed Jan. 6, 2026.

* cited by examiner

SAFETY SWITCH FOR A CONDUCTED ELECTRICAL WEAPON

FIELD OF THE INVENTION

Embodiments of the present disclosure relate to a conducted electrical weapon ("CEW").

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers refer to similar elements and steps throughout the figures.

Figure 1:
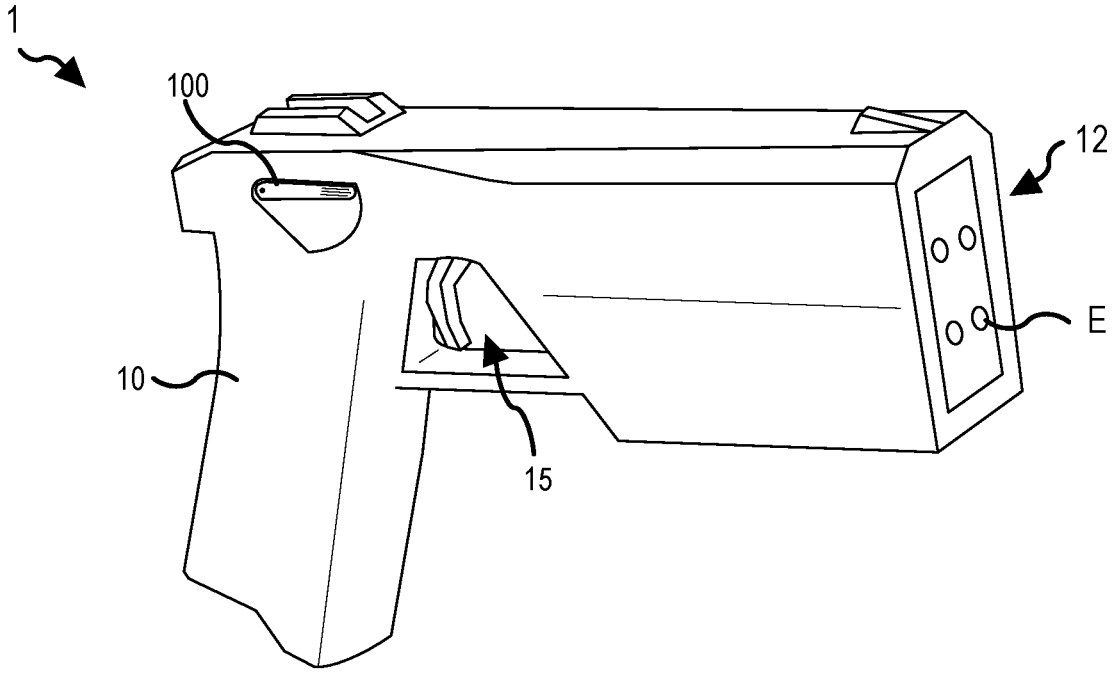
FIG. 1 is a perspective view of a conducted electrical weapon ("CEW"), in accordance with various embodiments.

Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

DETAILED DESCRIPTION

The detailed description of exemplary embodiments herein makes reference to the accompanying drawings, which show exemplary embodiments by way of illustration. While these embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation.

The scope of the disclosure is defined by the appended claims and their legal equivalents rather than by merely the examples described. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, coupled, connected, or the like may include permanent, removable, temporary, partial, full, and/or any other possible attachment option. Surface shading lines may be used throughout the figures to denote different parts but not necessarily to denote the same or different materials.

Systems, methods, and apparatuses may be used to interfere with voluntary locomotion (e.g., walking, running, moving, etc.) of a target. For example, a CEW may be used to deliver a current (e.g., stimulus signal, pulses of current, pulses of charge, etc.) through tissue of a human or animal target. Although typically referred to as a conducted electrical weapon, as described herein a "CEW" may refer to a conducted electrical weapon, a conducted energy weapon, an electronic control device, and/or any other similar device or apparatus configured to provide a stimulus signal through one or more deployed projectiles (e.g., electrodes).

A stimulus signal carries a charge into target tissue. The stimulus signal may interfere with voluntary locomotion of the target. The stimulus signal may cause pain. The pain may also function to encourage the target to stop moving. The stimulus signal may cause skeletal muscles of the target to become stiff (e.g., lock up, freeze, etc.). The stiffening of the muscles in response to a stimulus signal may be referred to as neuromuscular incapacitation ("NMI"). NMI disrupts voluntary control of the muscles of the target. The inability of the target to control its muscles interferes with locomotion of the target.

A stimulus signal may be delivered through the target via terminals coupled to the CEW. Delivery via terminals may be referred to as a local delivery (e.g., a local stun, a drive stun, etc.). During local delivery, the terminals are brought close to the target by positioning the CEW proximate to the target. The stimulus signal is delivered through the target's tissue via the terminals. To provide local delivery, the user of the CEW is generally within arm's reach of the target and brings the terminals of the CEW into contact with or proximate to the target.

A stimulus signal may be delivered through the target via one or more (typically at least two) wire-tethered electrodes. Delivery via wire-tethered electrodes may be referred to as a remote delivery (e.g., a remote stun). During a remote delivery, the CEW may be separated from the target up to the length (e.g., 15 feet, 20 feet, 30 feet, etc.) of the wire tether. The CEW launches the electrodes towards the target. As the electrodes travel toward the target, the respective wire tethers deploy behind the electrodes. The wire tether electrically couples the CEW to the electrode. The electrode may electrically couple to the target thereby coupling the CEW to the target. In response to the electrodes connecting with, impacting on, or being positioned proximate to the target's tissue, the current may be provided through the target via the electrodes (e.g., a circuit is formed through the first tether and the first electrode, the target's tissue, and the second electrode and the second tether).

Terminals or electrodes that contact or are proximate to the target's tissue deliver the stimulus signal through the target. Contact of a terminal or electrode with the target's tissue establishes an electrical coupling (e.g., circuit) with the target's tissue. Electrodes may include a spear that may pierce the target's tissue to contact the target. A terminal or electrode that is proximate to the target's tissue may use ionization to establish an electrical coupling with the target's tissue. Ionization may also be referred to as arcing.

In use (e.g., during deployment), a terminal or electrode may be separated from the target's tissue by the target's clothing or a gap of air. In various embodiments, a signal generator of the CEW may provide the stimulus signal (e.g., current, pulses of current, etc.) at a high voltage (e.g., in the range of 40,000 to 100,000 volts) to ionize the air in the clothing or the air in the gap that separates the terminal or electrode from the target's tissue. Ionizing the air establishes a low impedance ionization path from the terminal or electrode to the target's tissue that may be used to deliver the stimulus signal into the target's tissue via the ionization path. The ionization path persists (e.g., remains in existence, lasts, etc.) as long as the current of a pulse of the stimulus signal is provided via the ionization path. When the current ceases or is reduced below a threshold (e.g., amperage, voltage), the ionization path collapses (e.g., ceases to exist) and the terminal or electrode is no longer electrically coupled to the target's tissue. Lacking the ionization path, the impedance between the terminal or electrode and target tissue is high. A high voltage in the range of about 50,000 volts can ionize air in a gap of up to about one inch.

A CEW may provide a stimulus signal as a series of current pulses. Each current pulse may include a high voltage portion (e.g., 40,000-100,000 volts) and a low voltage portion (e.g., 500-6,000 volts). The high voltage portion of a pulse of a stimulus signal may ionize air in a gap between an electrode or terminal and a target to electrically couple the electrode or terminal to the target. In response to the electrode or terminal being electrically coupled to the target, the low voltage portion of the pulse delivers an amount of charge into the target's tissue via the ionization path. In response to the electrode or terminal being electrically coupled to the target by contact (e.g., touching, spear embedded into tissue, etc.), the high portion of the pulse and the low portion of the pulse both deliver charge to the target's tissue. Generally, the low voltage portion of the pulse delivers a majority of the charge of the pulse into the target's tissue. In various embodiments, the high voltage portion of a pulse of the stimulus signal may be referred to as the spark or ionization portion. The low voltage portion of a pulse may be referred to as the muscle portion.

In various embodiments, a signal generator of the CEW may provide the stimulus signal (e.g., current, pulses of current, etc.) at only a low voltage (e.g., less than 2,000 volts). The low voltage stimulus signal may not ionize the air in the clothing or the air in the gap that separates the terminal or electrode from the target's tissue. A CEW having a signal generator providing stimulus signals at only a low voltage (e.g., a low voltage signal generator) may require deployed electrodes to be electrically coupled to the target by contact (e.g., touching, spear embedded into tissue, etc.).

A CEW may include at least two terminals at the face of the CEW. A CEW may include two terminals for each bay that accepts a cartridge (e.g., cartridge). The terminals may be spaced apart from each other. In response to the electrodes of the cartridge in the bay having not been deployed, the high voltage impressed across the terminals will result in ionization of the air between the terminals. The arc between the terminals may be visible to the naked eye. In response to a launched electrode not electrically coupling to a target, the current that would have been provided via the electrodes may arc across the face of the CEW via the terminals.

The likelihood that the stimulus signal will cause NMI increases when the electrodes that deliver the stimulus signal are spaced apart at least 6 inches (15.24 centimeters) so that the current from the stimulus signal flows through the at least 6 inches of the target's tissue. In various embodiments, the electrodes preferably should be spaced apart at least 12 inches (30.48 centimeters) on the target. Because the terminals on a CEW are typically less than 6 inches apart, a stimulus signal delivered through the target's tissue via terminals likely will not cause NMI, only pain.

A series of pulses may include two or more pulses separated in time. Each pulse delivers an amount of charge into the target's tissue. In response to the electrodes being appropriately spaced (as discussed above), the likelihood of inducing NMI increases as each pulse delivers an amount of charge in the range of 55 microcoulombs to 71 microcoulombs per pulse. The likelihood of inducing NMI increases when the rate of pulse delivery (e.g., rate, pulse rate, repetition rate, etc.) is between 11 pulses per second ("pps") and 50 pps. Pulses delivered at a higher rate may provide less charge per pulse to induce NMI. Pulses that deliver more charge per pulse may be delivered at a lesser rate to induce NMI. In various embodiments, a CEW may be hand-held and use batteries to provide the pulses of the stimulus signal. In response to the amount of charge per pulse being high and the pulse rate being high, the CEW may use more energy than is needed to induce NMI. Using more energy than is needed depletes batteries more quickly.

Empirical testing has shown that the power of the battery may be conserved with a high likelihood of causing NMI in response to the pulse rate being less than 44 pps and the charge per a pulse being about 63 microcoulombs. Empirical testing has shown that a pulse rate of 22 pps and 63 microcoulombs per a pulse via a pair of electrodes will induce NMI when the electrode spacing is at least 12 inches (30.48 centimeters).

In various embodiments, a CEW may include a handle and one or more cartridges (e.g., deployment units, magazines, etc.). The handle may include one or more bays for receiving the cartridge(s). Each cartridge may be removably positioned in (e.g., inserted into, coupled to, etc.) a bay. Each cartridge may releasably electrically, electronically, and/or mechanically couple to a bay. A deployment of the CEW may launch one or more electrodes toward a target to remotely deliver the stimulus signal through the target.

In various embodiments, a cartridge may include two or more electrodes that are launched at the same time. In various embodiments, a cartridge may include two or more electrodes that may each be launched individually at separate times. In various embodiments, a cartridge may include a single electrode configured to be launched from the cartridge. Launching the electrodes may be referred to as activating (e.g., firing) a cartridge. After use (e.g., activation, firing), a cartridge may be removed from the bay and replaced with an unused (e.g., not fired, not activated) cartridge to permit launch of additional electrodes.

Figure 2:
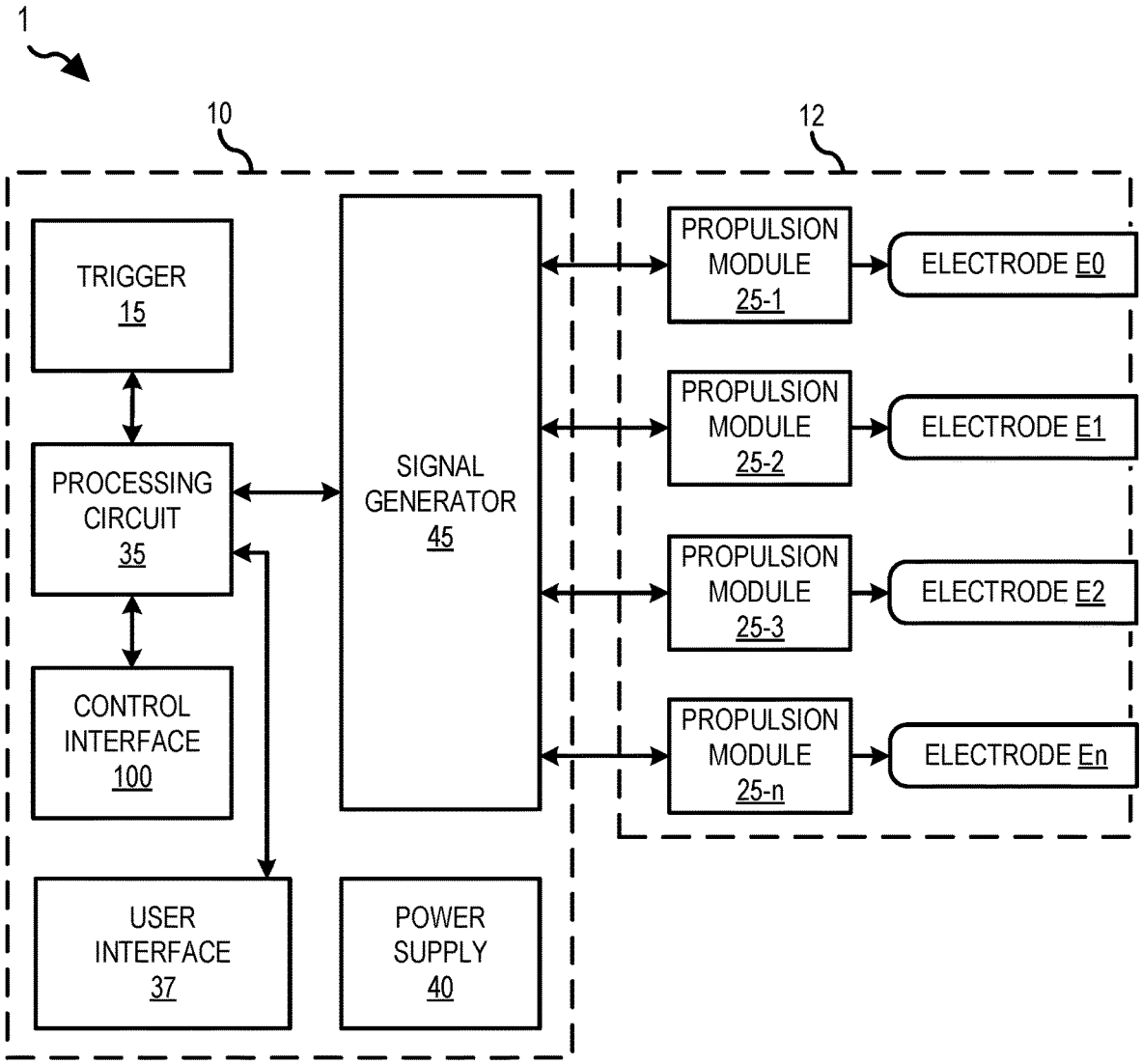
FIG. 2 is a schematic view of a CEW, in accordance with various embodiments.

In various embodiments, and with reference to FIGS. 1 and 2, a CEW 1 is disclosed. CEW 1 may be similar to, or have similar aspects and/or components with, any CEW discussed herein. CEW 1 may comprise a housing 10 and one or more cartridges 12 (e.g., deployment units). It should be understood by one skilled in the art that FIG. 2 is a schematic representation of CEW 1, and one or more of the components of CEW 1 may be located in any suitable position within, or external to, housing 10.

Housing 10 may be configured to house various components of CEW 1 that are configured to enable deployment of cartridges 12, provide an electrical current to cartridges 12, and otherwise aid in the operation of CEW 1, as discussed further herein. Although depicted as a firearm in FIG. 1, housing 10 may comprise any suitable shape and/or size. Housing 10 may comprise a handle end opposite a deployment end. A deployment end may be configured, and sized and shaped, to receive one or more cartridges 12. A handle end may be sized and shaped to be held in a hand of a user. For example, a handle end may be shaped as a handle to enable hand-operation of CEW 1 by the user. In various embodiments, a handle end may also comprise contours shaped to fit the hand of a user, for example, an ergonomic grip. A handle end may include a surface coating, such as, for example, a non-slip surface, a grip pad, a rubber texture, and/or the like. As a further example, a handle end may be wrapped in leather, a colored print, and/or any other suitable material, as desired.

In various embodiments, housing 10 may comprise various mechanical, electronic, and/or electrical components configured to aid in performing the functions of CEW 1. For example, housing 10 may comprise one or more triggers 15, control interfaces 100, processing circuits 35, power supplies 40, and/or signal generators 45. Housing 10 may include a guard (e.g., trigger guard). A guard may define an opening formed in housing 10. A guard may be located on a center region of housing 10 (e.g., as depicted in FIG. 1), and/or in any other suitable location on housing 10. Trigger 15 may be disposed within a guard. A guard may be configured to protect trigger 15 from unintentional physical contact (e.g., an unintentional activation of trigger 15). A guard may surround trigger 15 within housing 10.

In various embodiments, trigger 15 be coupled to an outer surface of housing 10, and may be configured to move, slide, rotate, or otherwise become physically depressed or moved upon application of physical contact. For example, trigger 15 may be actuated by physical contact applied to trigger 15 from within a guard. Trigger 15 may comprise a mechanical or electromechanical switch, button, trigger, or the like. For example, trigger 15 may comprise a switch, a pushbutton, and/or any other suitable type of trigger. Trigger 15 may be mechanically and/or electronically coupled to processing circuit 35. In response to trigger 15 being activated (e.g., depressed, pushed, etc. by the user), processing circuit 35 may enable deployment of (or cause deployment of) one or more cartridges 12 from CEW 1, as discussed further herein.

In various embodiments, power supply 40 may be configured to provide power to various components of CEW 1. For example, power supply 40 may provide energy for operating the electronic and/or electrical components (e.g., parts, subsystems, circuits, etc.) of CEW 1 and/or one or more cartridges 12. Power supply 40 may provide electrical power. Providing electrical power may include providing a current at a voltage. Power supply 40 may be electrically coupled to processing circuit 35 and/or signal generator 45. In various embodiments, in response to a control interface comprising electronic properties and/or components, power supply 40 may be electrically coupled to the control interface. In various embodiments, in response to trigger 15 comprising electronic properties or components, power supply 40 may be electrically coupled to trigger 15. Power supply 40 may provide an electrical current at a voltage. Electrical power from power supply 40 may be provided as a direct current ("DC"). Electrical power from power supply 40 may be provided as an alternating current ("AC"). Power supply 40 may include a battery. The energy of power supply 40 may be renewable or exhaustible, and/or replaceable. For example, power supply 40 may comprise one or more rechargeable or disposable batteries. In various embodiments, the energy from power supply 40 may be converted from one form (e.g., electrical, magnetic, thermal) to another form to perform the functions of a system.

Power supply 40 may provide energy for performing the functions of CEW 1. For example, power supply 40 may provide the electrical current to signal generator 45 that is provided through a target to impede locomotion of the target (e.g., via cartridge 12). Power supply 40 may provide the energy for a stimulus signal. Power supply 40 may provide the energy for other signals, including an ignition signal, as discussed further herein.

In various embodiments, processing circuit 35 may comprise any circuitry, electrical components, electronic components, software, and/or the like configured to perform various operations and functions discussed herein. For example, processing circuit 35 may comprise a processing circuit, a processor, a digital signal processor, a microcontroller, a microprocessor, an application specific integrated circuit (ASIC), a programmable logic device, logic circuitry, state machines, MEMS devices, signal conditioning circuitry, communication circuitry, a computer, a computer-based system, a radio, a network appliance, a data bus, an address bus, and/or any combination thereof. In various embodiments, processing circuit 35 may include passive electronic devices (e.g., resistors, capacitors, inductors, etc.) and/or active electronic devices (e.g., op amps, comparators, analog-to-digital converters, digital-to-analog converters, programmable logic, SRCs, transistors, etc.). In various embodiments, processing circuit 35 may include data buses, output ports, input ports, timers, memory, arithmetic units, and/or the like.

In various embodiments, processing circuit 35 may include signal conditioning circuitry. Signal conditioning circuitry may include level shifters to change (e.g., increase, decrease) the magnitude of a voltage (e.g., of a signal) before receipt by processing circuit 35 or to change the magnitude of a voltage provided by processing circuit 35.

In various embodiments, processing circuit 35 may be configured to control and/or coordinate operation of some or all aspects of CEW 1. For example, processing circuit 35 may include (or be in communication with) memory configured to store data, programs, and/or instructions. The memory may comprise a tangible non-transitory computer-readable memory. Instructions stored on the tangible non-transitory memory may allow processing circuit 35 to perform various operations, functions, and/or steps, as described herein.

In various embodiments, the memory may comprise any hardware, software, and/or database component capable of storing and maintaining data. For example, a memory unit may comprise a database, data structure, memory component, or the like. A memory unit may comprise any suitable non-transitory memory known in the art, such as, an internal memory (e.g., random access memory (RAM), read-only memory (ROM), solid state drive (SSD), etc.), removable memory (e.g., an SD card, an xD card, a CompactFlash card, etc.), or the like.

Processing circuit 35 may be configured to provide and/or receive electrical signals whether digital and/or analog in form. Processing circuit 35 may provide and/or receive digital information via a data bus using any protocol. Processing circuit 35 may receive information, manipulate the received information, and provide the manipulated information. Processing circuit 35 may store information and retrieve stored information. Information received, stored, and/or manipulated by processing circuit 35 may be used to perform a function, control a function, and/or to perform an operation or execute a stored program.

Processing circuit 35 may control the operation and/or function of other circuits and/or components of CEW 1. Processing circuit 35 may receive status information regarding the operation of other components, perform calculations with respect to the status information, and provide commands (e.g., instructions) to one or more other components. Processing circuit 35 may command another component to start operation, continue operation, alter operation, suspend operation, cease operation, or the like. Commands and/or status may be communicated between processing circuit 35 and other circuits and/or components via any type of bus (e.g., SPI bus) including any type of data/address bus.

In various embodiments, processing circuit 35 may be mechanically and/or electronically coupled to trigger 15. Processing circuit 35 may be configured to detect (or receive) an activation, actuation, depression, input, etc. (collectively, an "activation event") of trigger 15. In response to detecting the activation event, processing circuit 35 may be configured to perform various operations and/or functions, as discussed further herein. Processing circuit 35 may also include a sensor (e.g., a trigger sensor) attached to trigger 15 and configured to detect an activation event of trigger 15. The sensor may comprise any suitable sensor, such as a mechanical and/or electronic sensor capable of detecting an activation event in trigger 15 and reporting the activation event to processing circuit 35.

In various embodiments, processing circuit 35 may be mechanically and/or electronically coupled to control interface 100. Processing circuit 35 may be configured to detect an activation, actuation, depression, input, etc. (collectively, a "control event") of control interface 100. In response to detecting the control event, processing circuit 35 may be configured to perform various operations and/or functions, as discussed further herein. Processing circuit 35 may also include a sensor (e.g., a control sensor) attached to control interface 100 and configured to detect a control event of control interface 100. The sensor may comprise any suitable mechanical and/or electronic sensor capable of detecting a control event in control interface 100 and reporting the control event to processing circuit 35.

In various embodiments, processing circuit 35 may be electrically and/or electronically coupled to power supply 40. Processing circuit 35 may receive power from power supply 40. The power received from power supply 40 may be used by processing circuit 35 to receive signals, process signals, and transmit signals to various other components in CEW 1. Processing circuit 35 may use power from power supply 40 to detect an activation event of trigger 15, a control event of control interface 100, or the like, and generate one or more control signals in response to the detected events. The control signal may be based on the control event and the activation event. The control signal may be an electrical signal.

In various embodiments, processing circuit 35 may be electrically and/or electronically coupled to signal generator 45. Processing circuit 35 may be configured to transmit or provide control signals to signal generator 45 in response to detecting an activation event of trigger 15. Multiple control signals may be provided from processing circuit 35 to signal generator 45 in series. In response to receiving the control signal, signal generator 45 may be configured to perform various functions and/or operations, as discussed further herein.

In various embodiments, signal generator 45 may be configured to receive one or more control signals from processing circuit 35. Signal generator 45 may provide an ignition signal to cartridge 12 based on the control signals. Signal generator 45 may be electrically and/or electronically coupled to processing circuit 35 and/or cartridge 12. Signal generator 45 may be electrically coupled to power supply 40. Signal generator 45 may use power received from power supply 40 to generate an ignition signal. For example, signal generator 45 may receive an electrical signal from power supply 40 that has first current and voltage values. Signal generator 45 may transform the electrical signal into an ignition signal having second current and voltage values. The transformed second current and/or the transformed second voltage values may be different from the first current and/or voltage values. The transformed second current and/or the transformed second voltage values may be the same as the first current and/or voltage values. Signal generator 45 may temporarily store power from power supply 40 and rely on the stored power entirely or in part to provide the ignition signal. Signal generator 45 may also rely on received power from power supply 40 entirely or in part to provide the ignition signal, without needing to temporarily store power.

Signal generator 45 may be controlled entirely or in part by processing circuit 35. In various embodiments, signal generator 45 and processing circuit 35 may be separate components (e.g., physically distinct and/or logically discrete). Signal generator 45 and processing circuit 35 may be a single component. For example, a control circuit within housing 10 may at least include signal generator 45 and processing circuit 35. The control circuit may also include other components and/or arrangements, including those that further integrate corresponding function of these elements into a single component or circuit, as well as those that further separate certain functions into separate components or circuits.

Signal generator 45 may be controlled by the control signals to generate an ignition signal having a predetermined current value or values. For example, signal generator 45 may include a current source. The control signal may be received by signal generator 45 to activate the current source at a current value of the current source. An additional control signal may be received to decrease a current of the current source. For example, signal generator 45 may include a pulse width modification circuit coupled between a current source and an output of the control circuit. A second control signal may be received by signal generator 45 to activate the pulse width modification circuit, thereby decreasing a non-zero period of a signal generated by the current source and an overall current of an ignition signal subsequently output by the control circuit. The pulse width modification circuit may be separate from a circuit of the current source or, alternatively, integrated within a circuit of the current source. Various other forms of signal generators 45 may alternatively or additionally be employed, including those that apply a voltage over one or more different resistances to generate signals with different currents. In various embodiments, signal generator 45 may include a high-voltage module configured to deliver an electrical current having a high voltage. In various embodiments, signal generator 45 may include a low-voltage module configured to deliver an electrical current having a lower voltage, such as, for example, 2,000 volts.

Responsive to receipt of a signal indicating activation of trigger 15 (e.g., an activation event), a control circuit provides an ignition signal to cartridge 12. For example, signal generator 45 may provide an electrical signal as an ignition signal to cartridge 12 in response to receiving a control signal from processing circuit 35. In various embodiments, the ignition signal may be separate and distinct from a stimulus signal. For example, a stimulus signal in CEW 1 may be provided to a different circuit within cartridge 12, relative to a circuit to which an ignition signal is provided. Signal generator 45 may be configured to generate a stimulus signal. In various embodiments, a second, separate signal generator, component, or circuit (not shown) within housing 10 may be configured to generate the stimulus signal. Signal generator 45 may also provide a ground signal path for cartridge 12, thereby completing a circuit for an electrical signal provided to cartridge 12 by signal generator 45. The ground signal path may also be provided to cartridge 12 by other elements in housing 10, including power supply 40.

In various embodiments, a bay of housing 10 may be configured to receive one or more cartridges 12. For example, a bay of housing 10 may be configured to receive a single cartridge, two cartridges, three cartridges, nine cartridges, or any other number of cartridges.

A cartridge 12 may comprise one or more propulsion modules 25 and one or more electrodes E. For example, a cartridge 12 may comprise a single propulsion module 25 configured to deploy a single electrode E. As a further example, a cartridge 12 may comprise a single propulsion module 25 configured to deploy a plurality of electrodes E. As a further example, a cartridge 12 may comprise a plurality of propulsion modules 25 and a plurality of electrodes E, with each propulsion module 25 configured to deploy one or more electrodes E. In various embodiments, and as depicted in FIG. 2, cartridge 12 may comprise a first propulsion module 25-1 configured to deploy a first electrode E0, a second propulsion module 25-2 configured to deploy a second electrode E1, a third propulsion module 25-3 configured to deploy a third electrode E2, and an "Nth" propulsion module **25-*n*** configured to deploy an "Nth" electrode En. Each series of propulsion modules and electrodes may be contained in the same and/or separate cartridges.

In various embodiments, a propulsion module 25 may be coupled to, or in communication with one or more electrodes E in cartridge 12. In various embodiments, cartridge 12 may comprise a plurality of propulsion modules 25, with each propulsion module 25 coupled to, or in communication with, one or more electrodes E. A propulsion module 25 may comprise any device, propellant (e.g., air, gas, etc.), primer, or the like capable of providing a propulsion force in cartridge 12. The propulsion force may include an increase in pressure caused by rapidly expanding gas within an area or chamber. The propulsion force may be applied to one or more electrodes E in cartridge 12 to cause the deployment of the one or more electrodes E. A propulsion module 25 may provide the propulsion force in response to cartridge 12 receiving an ignition signal, as previously discussed.

In various embodiments, the propulsion force may be directly applied to one or more electrodes E. For example, a propulsion force from propulsion module 25-1 may be provided directly to first electrode E0. A propulsion module 25 may be in fluid communication with one or more electrodes E to provide the propulsion force. For example, a propulsion force from propulsion module 25-1 may travel within a housing or channel of cartridge 12 to first electrode E0. The propulsion force may travel via a manifold in cartridge 12.

In various embodiments, the propulsion force may be provided indirectly to one or more electrodes E. For example, the propulsion force may be provided to a secondary source of propellant within propulsion system 125. The propulsion force may launch the secondary source of propellant within propulsion system 125, causing the secondary source of propellant to release propellant. A force associated with the released propellant may in turn provide a force to one or more electrodes E. A force generated by a secondary source of propellant may cause the one or more electrodes E to be deployed from the cartridge 12 and CEW 1.

In various embodiments, each electrode E0, E1, E2, En may each comprise any suitable type of projectile. For example, one or more electrodes E may be or include a projectile, an electrode (e.g., an electrode dart), an entangling projectile (e.g., a net, a tether, a wrapping tether, etc.), a payload projectile (e.g., comprising a liquid or gas substance), or the like. An electrode may include a spear portion, designed to pierce or attach proximate a tissue of a target in order to provide a conductive electrical path between the electrode and the tissue, as previously discussed herein.

Control interface 100 of CEW 1 may comprise, or be similar to, any control interface disclosed herein. In various embodiments, control interface 100 may be configured to control selection of firing modes in CEW 1. Controlling selection of firing modes in CEW 1 may include disabling firing of CEW 1 (e.g., a safety mode, etc.), enabling firing of CEW 1 (e.g., an active mode, a firing mode, an escalation mode, etc.), controlling deployment of cartridges 12, and/or similar or other operations, as discussed further herein. In various embodiments, control interface 100 may also be configured to perform (or cause performance of) one or more operations that do not include the selection of firing modes. For example, control interface 100 may be configured to enable the selection of operating modes of CEW 1, selection of options within an operating mode of CEW 1, or similar selection or scrolling operations, as discussed further herein.

Control interface 100 may be located in any suitable location on or in housing 10. For example, control interface 100 may be coupled to an outer surface of housing 10. Control interface 100 may be coupled to an outer surface of housing 10 proximate trigger 15 and/or a guard of housing 10. Control interface 100 may be electrically, mechanically, and/or electronically coupled to processing circuit 35. In various embodiments, in response to control interface 100 comprising electronic properties or components, control interface 100 may be electrically coupled to power supply 40. Control interface 100 may receive power (e.g., electrical current) from power supply 40 to power the electronic properties or components.

Control interface 100 may be electronically or mechanically coupled to trigger 15. For example, and as discussed further herein, control interface 100 may function as a safety mechanism. In response to control interface 100 being set to a "safety mode," CEW 1 may be unable to launch electrodes from cartridge 12. For example, control interface 100 may provide a signal (e.g., a control signal) to processing circuit 35 instructing processing circuit 35 to disable deployment of electrodes from cartridge 12. As a further example, control interface 100 may electronically or mechanically prohibit trigger 15 from activating (e.g., prevent or disable a user from depressing trigger 15; prevent trigger 15 from launching an electrode; etc.).

Control interface 100 may comprise any suitable electronic or mechanical component capable of enabling selection of firing modes. For example, control interface 100 may comprise a fire mode selector switch, a safety switch, a safety catch, a rotating switch, a selection switch, a selective firing mechanism, and/or any other suitable mechanical control. As a further example, control interface 100 may comprise a slide, such as a handgun slide, a reciprocating slide, or the like. As a further example, control interface 100 may comprise a touch screen, user interface or display, or similar electronic visual component.

The safety mode may be configured to prohibit deployment of an electrode from cartridge 12 in CEW 1. For example, in response to a user selecting the safety mode, control interface 100 may transmit a safety mode instruction to processing circuit 35. In response to receiving the safety mode instruction, processing circuit 35 may prohibit deployment of an electrode from cartridge 12. Processing circuit 35 may prohibit deployment until a further instruction is received from control interface 100 (e.g., a firing mode instruction). As previously discussed, control interface 100 may also, or alternatively, interact with trigger 15 to prevent activation of trigger 15. In various embodiments, the safety mode may also be configured to prohibit deployment of a stimulus signal from signal generator 45, such as, for example, a local delivery and/or a remote delivery.

The firing mode may be configured to enable deployment of one or more electrodes from cartridge 12 in CEW 1. For example, and in accordance with various embodiments, in response to a user selecting the firing mode, control interface 100 may transmit a firing mode instruction to processing circuit 35. In response to receiving the firing mode instruction, processing circuit 35 may enable deployment of an electrode from cartridge 12. In that regard, in response to trigger 15 being activated, processing circuit 35 may cause the deployment of one or more electrodes. Processing circuit 35 may enable deployment until a further instruction is received from control interface 100 (e.g., a safety mode instruction). As a further example, and in accordance with various embodiments, in response to a user selecting the firing mode, control interface 100 may also mechanically (or electronically) interact with trigger 15 of CEW 1 to enable activation of trigger 15.

In various embodiments, CEW 1 may deliver a stimulus signal via a circuit that includes signal generator 45 positioned in the handle of CEW 1. An interface (e.g., cartridge interface, magazine interface, etc.) on each cartridge 12 inserted into housing 10 electrically couples to an interface (e.g., handle interface, housing interface, etc.) in handle housing 10. Signal generator 45 couples to each cartridge 12, and thus to the electrodes E, via the handle interface and the cartridge interface. A first filament couples to the interface of the cartridge 12 and to a first electrode. A second filament couples to the interface of the cartridge 12 and to a second electrode. The stimulus signal travels from signal generator 45, through the first filament and the first electrode, through target tissue, and through the second electrode and second filament back to signal generator 45.

In various embodiments, CEW 1 may further comprise one or more user interfaces 37. A user interface 37 may be configured to receive an input from a user of CEW 1 and/or transmit an output to the user of CEW 1. User interface 37 may be located in any suitable location on or in housing 10. For example, user interface 37 may be coupled to an outer surface of housing 10, or extend at least partially through the outer surface of housing 10. User interface 37 may be electrically, mechanically, and/or electronically coupled to processing circuit 35. In various embodiments, in response to user interface 37 comprising electronic or electrical properties or components, user interface 37 may be electrically coupled to power supply 40. User interface 37 may receive power (e.g., electrical current) from power supply 40 to power the electronic properties or components.

In various embodiments, user interface 37 may comprise one or more components configured to receive an input from a user. For example, user interface 37 may comprise one or more of an audio capturing module (e.g., microphone) configured to receive an audio input, a visual display (e.g., touchscreen, LCD, LED, etc.) configured to receive a manual input, a mechanical interface (e.g., button, switch, etc.) configured to receive a manual input, and/or the like. In various embodiments, user interface 37 may comprise one or more components configured to transmit or produce an output. For example, user interface 37 may comprise one or more of an audio output module (e.g., audio speaker) configured to output audio, a light-emitting component (e.g., flashlight, laser guide, etc.) configured to output light, a visual display (e.g., touchscreen, LCD, LED, etc.) configured to output a visual, and/or the like.

Figure 3:
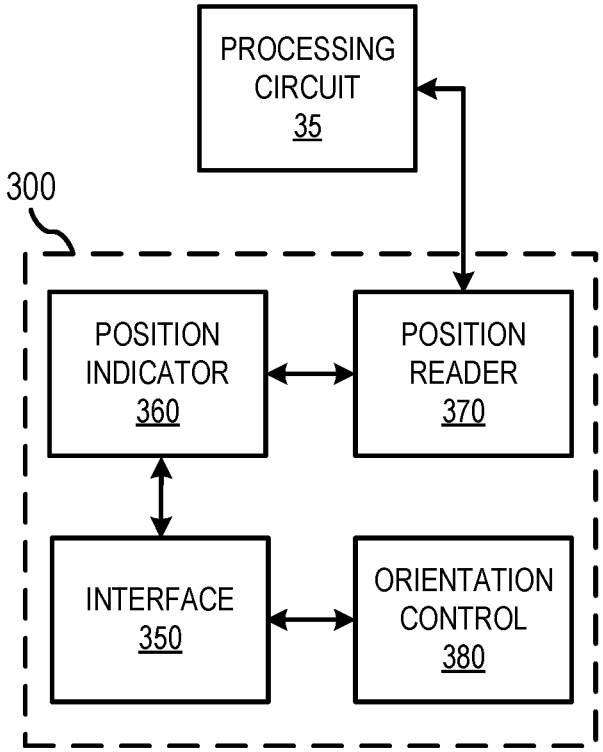
FIG. 3 is a block diagram illustrating a control interface for a CEW, in accordance with various embodiments.

In various embodiments, and with reference to FIG. 3, a control interface 300 is disclosed. Control interface 300 may be similar to any other control interface, safety switch, or the like disclosed herein. Control interface 300 may comprise any suitable electronic or mechanical component capable of enabling selection of firing modes, operating modes, or the like. For example, control interface 300 may comprise a fire mode selector switch, a safety switch, a safety catch, a rotating switch, a selection switch, a selective firing mechanism, and/or any other suitable mechanical control. As a further example, control interface 300 may comprise a slide, such as a handgun slide, a reciprocating slide, or the like.

In various embodiments, control interface 300 may be configured to control selection of firing modes. Controlling selection of firing modes in a CEW may include disabling firing of CEW 1 (e.g., a safety mode, etc.), enabling firing of a CEW (e.g., an active mode, a firing mode, an escalation mode, etc.), controlling deployment of cartridges from a CEW, and/or similar operations, as discussed further herein. In various embodiments, control interface 300 may also be configured to perform (or cause performance of) one or more operations that do not include the selection of firing modes. For example, control interface 300 may be configured to enable the selection of operating modes of a CEW, selection of options within an operating mode of a CEW, and/or similar selection or scrolling operations, as discussed further herein.

In various embodiments, control interface 300 may be configured to operate between at least one fixed position (e.g., fixed orientation) and at least one momentary position (e.g., momentary orientation). As discussed herein, a fixed position may refer to a control interface being operated into a position wherein in response the control interface no longer being operated, the control interface is configured to remain in the position (e.g., does not move from the position). For example, a user may manually operate the control interface into a fixed position. In response to the user no longer operating the control interface, the control interface may remain in the fixed position.

As discussed herein, a momentary position may be defined as a position that is not a fixed position. The momentary position may be configured to return to a fixed position in response to the control interface no longer being operated. For example, a user may manually operate the control interface into a momentary position. During the time the user continues to operate the control interface into the momentary position, the control interface may be configured to remain in the momentary position. In response to the user no longer operating the control interface (e.g., manually releasing the control interface), the control interface may return to a fixed position and no longer remain in the momentary position.

For example, a control interface may begin in a fixed position. In some embodiments, a mechanical interference may cause the control interface to remain in the fixed position until the control interface receives a force causing movement of the control interface. A first force may cause the control interface to operate into a momentary position. The first force may include a manual force provided by a user while operating the control interface. In response to the first force being removed (e.g., the user releases the control interface), a second force may cause the control interface to operate from the momentary position back into the fixed position. The second force may be different from the first force. The second force may be a different type of force than the first force. The second force may be applied from a component of the CEW, wherein the first force is applied from an external source. The second force may include a biasing force (e.g., a spring force) or other force provided to cause the control interface to return to the fixed position.

As a further example, a control interface may begin a fixed position. In some embodiments, a mechanical interference may cause the control interface to remain in the fixed position until the control interface receives a force causing movement of the control interface. A first force may cause the control interface to operate into a first momentary position. The first force may include a manual force provided by a user while operating the control interface. The first force may include a movement of the control interface in a first direction away from the fixed position. In response to the first force being removed (e.g., the user releases the control interface), a second force may cause the control interface to operate from the first momentary position back into the fixed position. The second force may be different from the first force. The second force may be a different type of force than the first force. The second force may be applied from a component of the CEW, wherein the first force is applied from an external source. The second force may include a biasing force or other force provided to cause the control interface to return to the fixed position.

A third force may cause the control interface to operate into a second momentary position. The third force may include a manual force provided by a user while operating the control interface. The third force may be similar to, or the same as, the first force. The third force may be a same type of force as the first force. The first force may include a movement of the control interface in a second direction away from the fixed position. The second direction may be an opposite direction from the first direction. In response to the third force being removed (e.g., the user releases the control interface), a fourth force may cause the control interface to operate from the second momentary position back into the fixed position. The fourth force may be similar to, or the same as, the second force. The fourth force may be a same type of force as the second force. The fourth force may be applied from a component of the CEW. The fourth force may include a biasing force or other force provided to cause the control interface to return to the fixed position.

As a further example, a control interface may comprise a first fixed position, a second fixed position, a first momentary position, and a second momentary position. The control interface may begin in the first fixed position or the second fixed position. A first force may cause the control interface to operate between the first fixed position and the second fixed position. The first force may include a manual force provided by a user while operating the control interface. The first force may include a movement of the control interface from the first fixed position to the second fixed position, or from the second fixed position to the first fixed position. In response to the first force being removed (e.g., the user releases the control interface), the control interface may remain in the respective first fixed position or second fixed position. In some embodiments, in response to the first force causing operation into the first fixed position, a first mechanical interference may cause the control interface to remain in the first fixed position until the control interface receives a force causing movement of the control interface out of the first fixed position. In some embodiments, in response to the first force causing operation into the second fixed position, a second mechanical interference may cause the control interface to remain in the second fixed position until the control interface receives a force causing movement of the control interface out of the second fixed position.

The control interface may be operated from the first fixed position to at least one of the first momentary position or the second momentary position. A second force may cause the control interface to operate into the first momentary position or the second momentary position. The second force may include a manual force provided by a user while operating the control interface. The second force may include a movement of the control interface from the first fixed position to the first momentary position, or from the first fixed position to the second momentary position. In response to the second force being removed (e.g., the user releases the control interface), a third force may cause the control interface to operate from the respective first momentary position or second momentary position back into the first fixed position. The third force may be different from the first force and/or the second force. The third force may be a different type of force than the first force and/or the second force. The third force may be applied from a component of the CEW, wherein the first force and/or the second force is applied from an external source. The third force may include a biasing force or other force provided to cause the control interface to return to the first fixed position.

The control interface may be operated from the second fixed position to at least one of the first momentary position or the second momentary position. A fourth force may cause the control interface to operate into the first momentary position or the second momentary position. The fourth force may include a manual force provided by a user while operating the control interface. The fourth force may include a movement of the control interface from the second fixed position to the first momentary position, or from the second fixed position to the second momentary position. In response to the fourth force being removed (e.g., the user releases the control interface), a fifth force may cause the control interface to operate from the respective first momentary position or second momentary position back into the second fixed position. The fifth force may be different from the first force, the second force, and/or the fourth force. The fifth force may be a different type of force than the first force, the second force, and/or the fourth force. The fifth force may be similar to, or the same as, the third force. The fifth force may be a same type of force as the third force. The fifth force may be applied from a component of the CEW, wherein the first force, the second force, and/or the fourth force is applied from an external source. The fifth force may include a biasing force or other force provided to cause the control interface to return to the second fixed position.

In various embodiments, a CEW may perform operations based on control interface 300 being operated into a fixed position or a momentary position. For example, in response to control interface 300 being operated into a fixed position, the CEW may be configured to perform an arming operation (e.g., a firing mode operation). The arming operation may comprise enabling deployment of the CEW (e.g., an armed mode, a firing mode, a safety off mode, etc.) or disabling deployment of the CEW (e.g., a safety mode, a safety on mode, etc.). Disabling deployment of the CEW may include disabling one or more components of the CEW. Enabling deployment of the CEW may include enabling (e.g., providing power to) one or more components of the CEW.

As a further example, in response to control interface 300 being operated into a momentary position, the CEW may be configured to perform a non-arming operation (e.g., non-firing mode operation). The non-arming operation may comprise an operation different from enabling or disabling deployment of the CEW. The non-arming operation may comprise an operation unrelated to directly enabling or disabling deployment of the CEW. For example, a non-arming operation may include disabling or enabling one or more components of the CEW, such as a flashlight, a laser, and/or the like. As a further example, a non-arming operation may include entering an operating mode of the CEW, such as a training mode, a manufacturing mode, a functional test mode, a stealth mode, a virtual reality mode, and/or the like.

In various embodiments, the non-arming operation may be based on an operating mode of the CEW. For example, in response to the CEW entering an operating mode of the CEW, such as a training mode, a manufacturing mode, a functional test mode, a stealth mode, a virtual reality mode, and/or the like, a second operation of control interface 300 into the momentary position may cause the CEW to perform a selection operation within the operating mode. A selection operation may comprise selecting an option, a function, or the like within the (previously selected) operating mode. For example, the CEW may display one or more options on the user interface of the CEW. A selection operation may scroll through the displayed options.

In various embodiments, the non-arming operation may be based on a deployment status of the deployment unit. For example, in response to the deployment unit having previously deployed one or more electrodes, the non-arming operation may comprise reenergizing the electrodes by providing a second stimulus signal through the electrodes. The non-arming operation in that respect may further include transmitting sound outputs, transmitting light outputs, or the like.

In various embodiments, the non-arming operation may be based on a type of deployment unit of the CEW. For example, a training deployment unit may enable a first set of functionalities, a standard deployment unit may enable a second set of functionalities, a virtual reality (VR) deployment unit may enable a third set of functionalities, etc. The CEW may select or enable one or more non-arming operations at least partially based on the functionalities present or enabled in a detected deployment unit.

In various embodiments, the non-arming operation may be based on a time that the interface is operated into the momentary position before returning to the fixed position. For example, in response to control interface 300 being operated into the momentary position for a first time (e.g., 5 seconds) the CEW may perform a first non-arming operation. In response to control interface 300 being operated into the momentary position for a second time (e.g., 10 seconds) the CEW may perform a second non-arming operation different from the first non-arming operation.

In various embodiments, and with reference to FIGS. 4A-4D, control interface 300 may be operated between a first fixed position, a second fixed position, a first momentary position, and/or a second momentary position.

Figure 4A:
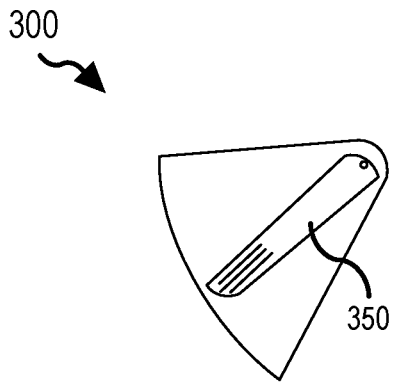
FIG. 4A depicts a control interface in a first fixed position, in accordance with various embodiments.

As depicted in FIG. 4A, the first fixed position may comprise a safety mode position (e.g., an off mode position, etc.). In the first fixed position, deployment of the CEW may be disabled. Control interface 300 may enter the first fixed position by operation of interface 350 into the first fixed position. In response to control interface 300 no longer being operated, interface 350 may remain in the first fixed position.

Figure 4B:
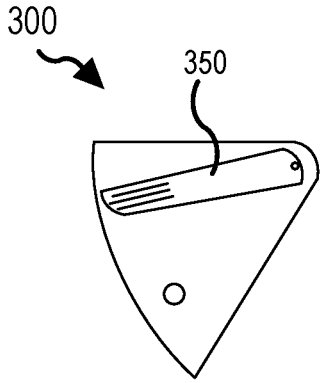
FIG. 4B depicts a control interface in a second fixed position, in accordance with various embodiments.

As depicted in FIG. 4B, the second fixed position may comprise a firing mode position (e.g., an armed mode position, an on mode position, etc.). The second fixed position may be different than the first fixed position. In the second fixed position, deployment of the CEW may be enabled. Control interface 300 may enter the second fixed position by operation of interface 350 into the second fixed position. In response to control interface 300 no longer being operated, interface 350 may remain in the second fixed position.

Figure 4C:
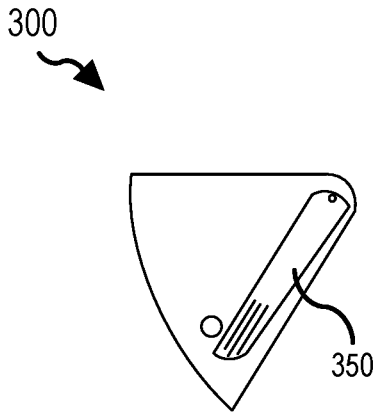
FIG. 4C depicts a control interface in a first momentary position, in accordance with various embodiments.

As depicted in FIG. 4C, the first momentary position may comprise a momentary down position. Control interface 300 may enter the momentary down position by operation of interface from the first fixed position (e.g., as depicted in FIG. 4A) to the momentary down position. In response to control interface 300 no longer being operated to the momentary down position, interface 350 may return from the momentary down position back to the first fixed position.

Figure 4D:
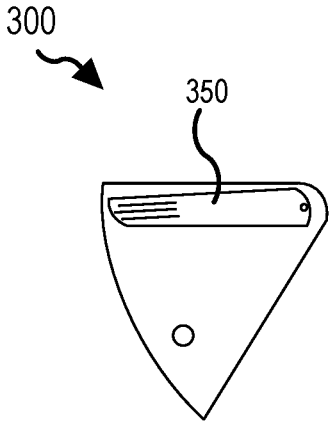
FIG. 4D depicts a control interface in a second momentary position, in accordance with various embodiments.

As depicted in FIG. 4D, the second momentary position may comprise a momentary up position. Control interface 300 may enter the momentary up position by operation of interface from the second fixed position (e.g., as depicted in FIG. 4B) to the momentary up position. In response to control interface 300 no longer being operated to the momentary up position, interface 350 may return from the momentary up position back to the second fixed position.

In various embodiments, and with reference again to FIG. 3, control interface 300 may comprise one or more of an interface 350, a position indicator 360, a position reader 370, and/or an orientation control 380.

In various embodiments, interface 350 may be configured to enable operation of control interface 300. For example, interface 350 may be manually operated (e.g., translated, rotated, pushed, etc.) by a user of a CEW. Responsive to operation of interface 350, control interface 300, processing circuit 35, and/or an other component of a CEW may perform one or more operations, as discussed further herein.

Interface 350 may comprise a mechanical or electromechanical device. For example, interface 350 may comprise a switch, a button, a toggle, a lever, a slide, and/or the like. Interface 350 may be coupled to position indicator 360 and/or orientation control 380. In some embodiments, interface 350 may also be coupled to position reader 370.

Control interface 300 may comprise any number of interfaces 350. For example, in various embodiments, control interface 300 may comprise a single interface 350. The single interface 350 may be oriented and located on an outer surface of a CEW. The single interface 350 may be arranged based on a deployment orientation. For example, a right-handed user may typically hold a CEW using the user's dominant right hand and may operate the single interface 350 using the user's right thumb. In that regard, the single interface 350 may be located on a left side of the CEW. As a further example, a left-handed user may typically hold a CEW using the user's dominant left hand and may operate the single interface 350 using the user's left thumb. In that regard, the single interface 350 may be located on a right side of the CEW. As a further example, the single interface 350 may comprise a slide usable by either right or left-handed users.

In various embodiments, control interface 300 may comprise a plurality of interfaces 350, such as a first interface 350 (e.g., a right interface) and a second interface 350 (e.g., a left interface). The first interface 350 may be located on a first side of the CEW (e.g., the right side) and the second interface 350 may be located on the second side of the CEW (e.g., the left side). Operation of either the first interface 350 or the second interface 350 may operate control interface 300. In some embodiments, the first interface 350 may be rotational coupled to, or in rotational series with, the second interface 350. In that regard, movement of one of the first interface 350 or the second interface 350 causes a same movement of the opposite of the first interface 350 or the second interface 350. Control interface 300 may comprise an ambidextrous orientation wherein control interface 300 is operable by a user using either hand (or both hands).

In various embodiments, orientation control 380 may be configured to enable operation of interface 350 into one or more fixed positions and/or one or more momentary positions. For example, orientation control 380 may be configured to enable interface 350 to move between a first fixed position and a second fixed position. Orientation control 350 may also be configured to enable interface 350 to move into one or more momentary positions. For example, orientation control 350 may enable interface 350 to move into a momentary position, and in response to interface 350 no longer being operated, cause interface 350 to return to a fixed position.

Orientation control 380 may be coupled to, or engaged with, one or more interfaces 350. Orientation control 380 may be positioned within a handle of a CEW. In some embodiments, orientation control 380 may comprise (wholly or at least partially) a portion of interface 350. In some embodiments, orientation control 380 may comprise (wholly or at least partially) a portion of an outer surface of a handle of a CEW.

In various embodiments, and as discussed further herein, orientation control 380 may comprise one or more mechanical features (e.g., orientation mechanical features) configured to interface with one or more mechanical features coupled to an interface 350 (e.g., interface mechanical features). The interface of interface 350 and the one or more mechanical features may cause an interference between interface 350 and the one or more mechanical features. The interference between the respective components may enable interface 350 to be operated into a fixed position and remain in the fixed position. The interference between the respective components may also enable interface 350 to be operated into a momentary position, and return interface 350 to a fixed position after interface 350 is no longer operated. For example, in a fixed position a first interference may cause interface 350 to remain in the fixed position unless a force on interface 350 causes interface 350 to move from the fixed position (e.g., a manual force applied on interface 350 by a user). In a momentary position, a second interference may cause interface 350 to return to a fixed position in response to the force on interface 350 no longer being applied (e.g., a user ceases applying the manual force on interface 350). In that regard, the second interference may apply a force (e.g., a bias force, a spring force, etc.) to interface 350 causing interface 350 to return to the fixed position.

In various embodiments, position indicator 360 may be configured to indicate a position that interface 350 is operated into. For example, position indicator 360 may be configured to indicate that interface 350 has been operated into a fixed position or a momentary position. As a further example, position indicator 360 may be configured to indicate that interface 350 has been operated into a first fixed position, a second fixed position, a first momentary position, a second momentary position, and/or the like. Position indicator 360 may comprise one or more mechanical, electronic, and/or electrical features. Position indicator 360 may be coupled to, or engaged with, interface 350. Position indicator 360 may also be coupled to, or engaged with, position reader 370.

Position indicator 360 may be configured to indicate a position of interface 350 using any suitable process or technique. For example, and in accordance with various embodiments, position indicator 360 may be configured to move (e.g., operate, translate, rotate, etc.) responsive to movement of interface 350. In that regard, movement of interface 350 may cause movement of position indicator 360 into an indicated position. In the indicated position, position indicator 360 may indicate the position that interface 350 has been operated into. Position indicator 360 may be configured to indicate the position using any suitable technique, including a mechanical indication, an electronic or electrical indication, or the like. For example, movement of interface 350 into a first fixed position may similarly move position indicator 360 into a first fixed indicated position. Similarly, movement of interface 350 into a first momentary position may move position indicator 360 into a first momentary indicated position.

In various embodiments, position reader 370 may be configured to provide information regarding the position that interface 350 is operated into. For example, position reader 370 may be configured to provide the position of interface 350 based on the position (e.g., the indicated position) of position indicator 360. In that regard, position reader 370 may comprise any device or component configured to detect or determine the position of position indicator 360. For example, position reader 370 may comprise a detector, sensor, device, or the like configured to detect or determine the position of position indicator 360.

In various embodiments, position reader 370 may comprise a timer module configured to calculate or determine a time that interface 350 is operated into a position. The timer module may comprise any suitable software or hardware component configured to provide timing capabilities. In some embodiments, the timer module may be at least partially implemented in processing circuit 35. The timer module may calculate or determine a time that interface 350 is operated into a momentary position. The time may start in response to interface 350 entering into the momentary position, and the time may end in response to interface 350 leaving the momentary position and returning to a fixed position.

In various embodiments, position reader 370 may comprise a counting module configured to calculate or determine a number of subsequent operations that interface 350 is operated into a momentary position. Subsequent operations may be determined within an operation time (e.g., each operation into a same momentary position within 5 seconds, wherein a first operation starts the operation time; a second operation into a momentary position occurring within 2 seconds of a first operation into the momentary position; etc.). The operation time may be calculated or determined by the counting module and/or the timer module. The counting module may comprise any suitable software or hardware component configured to provide counting capabilities. In some embodiments, the counting module may be at least partially implemented in processing circuit 35.

Position reader 370 may be coupled to, or interfaced with, position indicator 360. Position reader 370 may also be in electronic communication with processing circuit 35. Position reader 370 may provide (actively or passively) the position of interface 350 to processing circuit 35. In response to determining the position of interface 350, processing circuit 35 may perform one or more operations, as discussed further herein.

In various embodiments, one or more of the components of control interface 300 may comprise a single component or may be combined or integrated into one or more other components. For example, in some embodiments position indicator 360 and position reader 370 may comprise a single component. As a further example, in some embodiments position indicator 360 and orientation control 380 may comprise a single component.

Figure 5A:
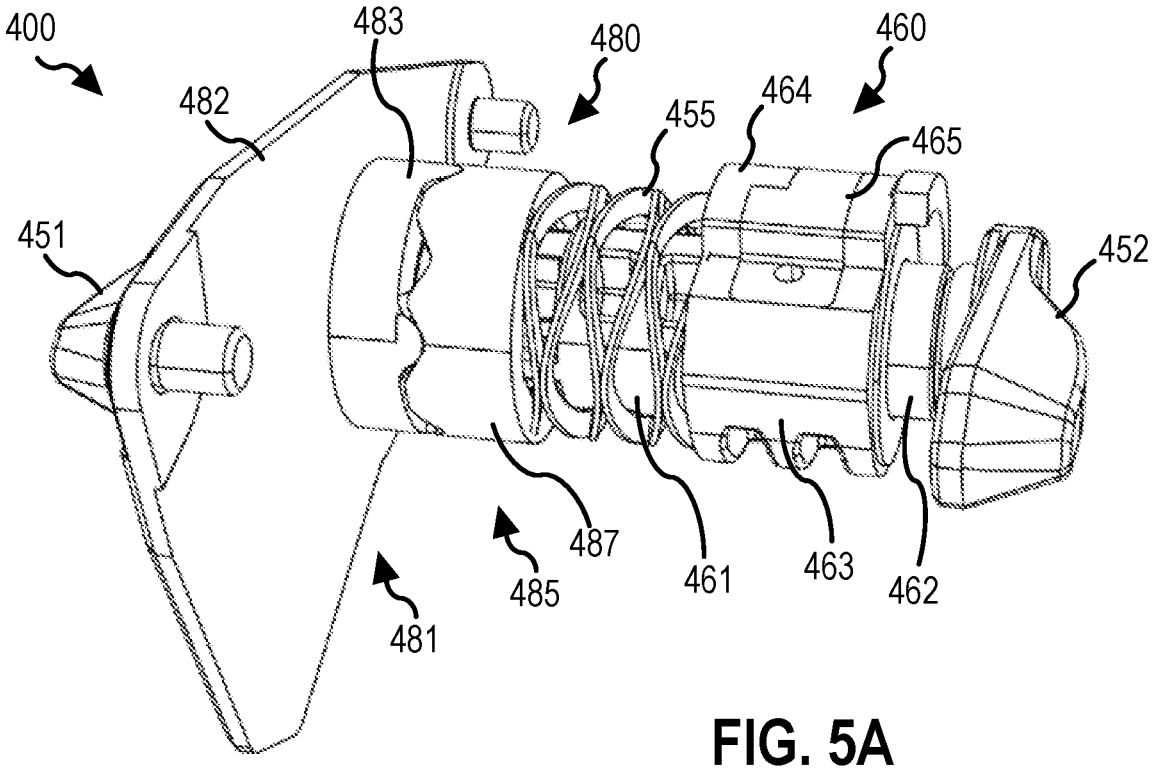
FIG. 5A is a perspective view of a control interface, in accordance with various embodiments.
Figure 5B:
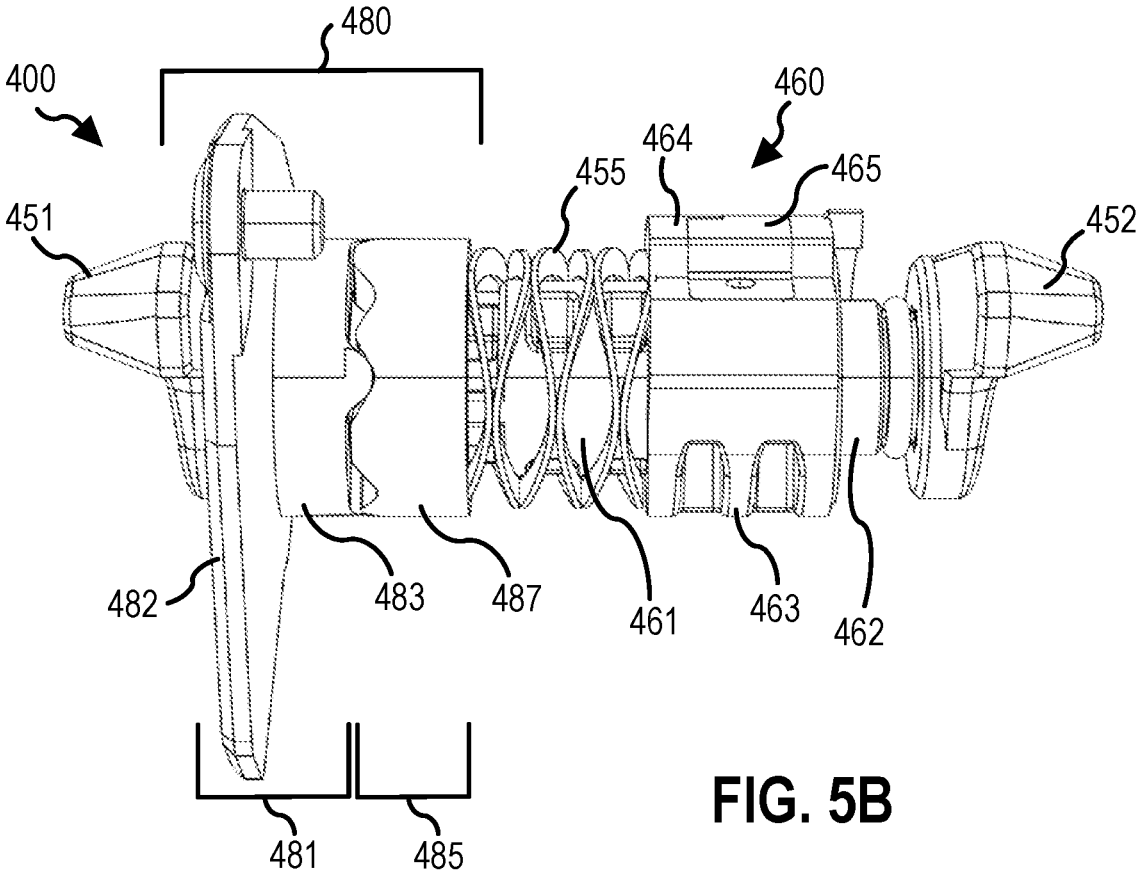
FIG. 5B is front view of the control interface of FIG. 5A, in accordance with various embodiments.
Figure 5C:
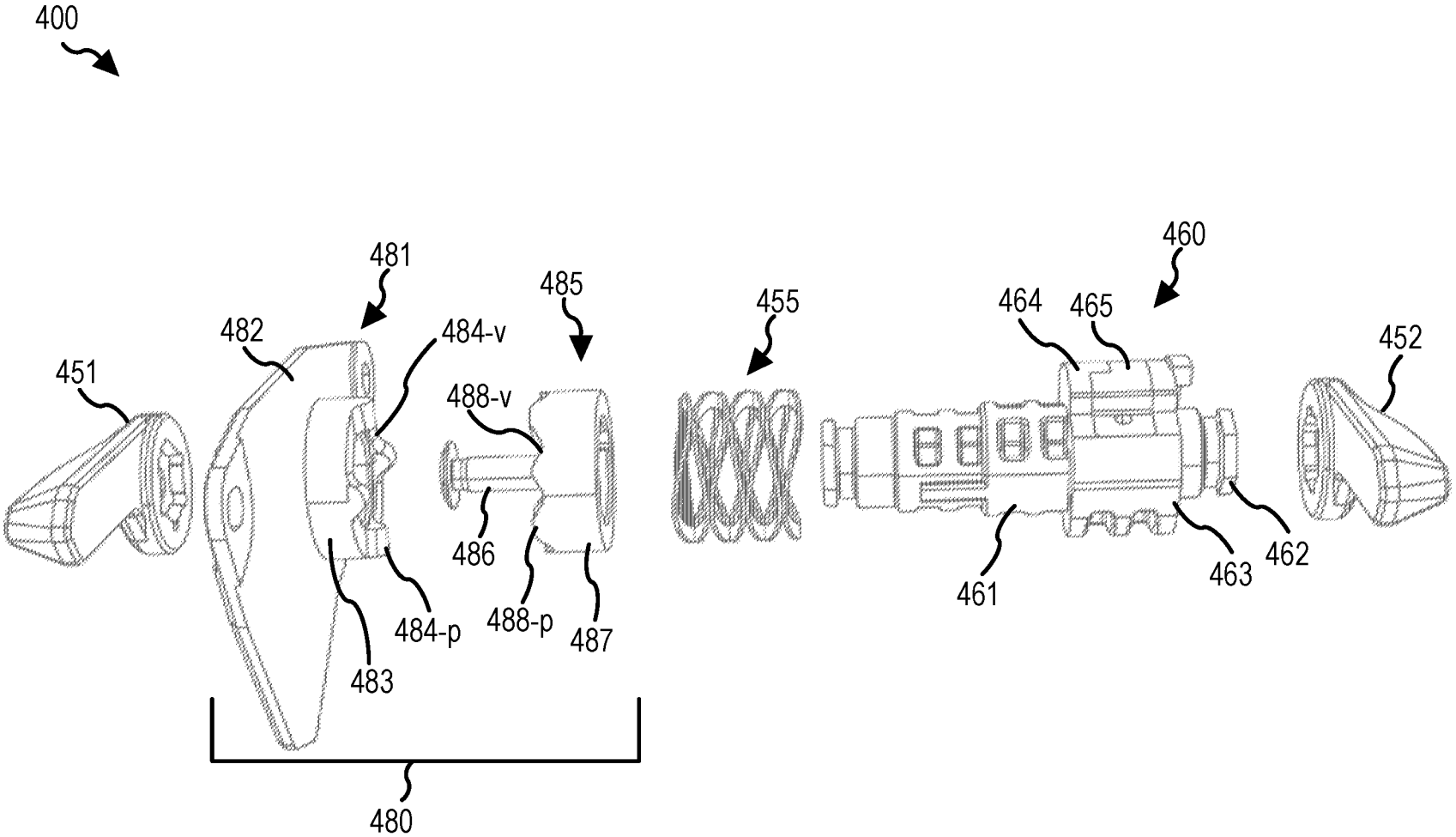
FIG. 5C is an exploded perspective view of the control interface of FIG. 5A, in accordance with various embodiments.

In various embodiments, and with reference to FIGS. 5A-5C, a control interface 400 is disclosed. Control interface 400 may be similar to any other control interface, safety switch, or the like disclosed herein. Control interface 400 may comprise one or more of a right lever 451, an orientation control 480, a bias spring 455, a position indicator 460, and/or a left lever 452.

In various embodiments, right lever 451 and/or left lever 452 may be similar to any other interface of a control interface disclosed here. Right lever 451 and/or left lever 452 may be configured to enable operation of control interface 400. Right lever 451 and left lever 452 may be coaxial. Operation of right lever 451 may cause similar movement of left lever 452. Operation of left lever 452 may cause similar movement of right lever 451. Right lever 451 may be positioned on an outer surface of a CEW on a right side of the CEW, opposite left lever 452. Left lever 452 may be position on the outer surface of the CEW on a left side of the CEW, opposite right lever 451.

In various embodiments, orientation control 480 may be similar to any other orientation control for a control interface disclosed herein. Orientation control 480 may comprise a stationary control 481 and a translatable control 485. Stationary control 481 and translatable control 485 may be coaxial. Stationary control 481 and translatable control 485 may be configured to mechanically interface to enable and control operation of control interface 400. Enabling and controlling operation of control interface 400 may include enabling movement of right lever 451 and/or left lever 452 into a fixed position. Enabling and controlling operation of control interface 400 may include enabling movement of right lever 451 and/or left lever 452 into a momentary position, before returning right lever 451 and/or left lever 452 into a fixed position.

In various embodiments, stationary control 481 may comprise a fixed surface 482 and/or a fixed mating surface 483. In response to operation of right lever 451 and/or left lever 452, fixed surface 482 and/or fixed mating surface 483 may remain stationary. Fixed surface 482 may comprise a portion of an outer surface of a CEW handle. Fixed surface 482 may also comprise a surface configured to couple to a surface of a CEW handle (e.g., coupled to an exterior of the outer surface, coupled to an interior of the outer surface, etc.).

Fixed mating surface 483 may comprise a protrusion on an inner surface of fixed surface 482. The protrusion may extend axially inward from fixed surface 482 (e.g., towards left lever 452). Fixed mating surface 483 may comprise a mating edge defining an opening through fixed mating surface 483. The mating edge may comprise one or more mating protrusions 484-*p* (e.g., fixed mating protrusions) and/or mating valleys 484-*v* (e.g., fixed mating valleys). The one or more mating protrusions 484-*p* and mating valleys 484-*v* may circumferentially define the mating edge.

Each mating protrusion 484-*p* may define a portion of the mating edge that protrudes from the mating edge (e.g., protrudes further axially inward from fixed surface 482, in a direction towards fixed control 485). Each mating valley 484-*v* may define a portion of the mating edge that does not protrude from the mating edge (e.g., in comparison to a mating protrusion 484-*p*), or protrudes less than a mating protrusion 484-*p*. Mating protrusions 484-*p* and/or mating valleys 484-*v* may be configured to interface with mating protrusions and mating valleys of translatable mating surface 487. The interface (e.g., engagement) between the respective mating protrusions and mating valleys may enable movement to fixed positions and momentary positions, as discussed further herein.

In various embodiments, translatable control 485 may comprise an engagement shaft 486 and/or a translatable mating surface 487. Engagement shaft 486 may be coupled to right lever 451. In that regard, operation of right lever 451 may cause movement of translatable control 485 via engagement shaft 486. Engagement shaft 486 may be inserted through an opening of fixed mating surface 483 to couple translatable control 485 to right lever 451.

Translatable mating surface 487 may comprise a mating edge axially opposite a spring engagement edge. The mating edge may be configured to interface with fixed mating surface 482. The spring engagement edge may be configured to interface with bias spring 455. The spring engagement edge may define an opening in translatable mating surface 487. The opening may be configured to receive translatable shaft 461 to couple translatable mating surface 487 to position indicator 460, as discussed further herein.

The mating edge of translatable mating surface 487 may comprise one or more mating protrusions 488-*p* (e.g., translatable mating protrusions) and/or mating valleys 488-*v* (e.g., translatable mating valleys). The one or more mating protrusions 488-*p* and mating valleys 488-*v* may circumferentially define the mating edge. Each mating protrusion 488-*p* may define a portion of the mating edge that protrudes from the mating edge towards fixed mating surface 483. (e.g., protrudes axially towards fixed mating surface 483). Each mating valley 488-*v* may define a portion of the mating edge that does not protrude from the mating edge (e.g., in comparison to a mating protrusion 488-*p*), or protrudes less than a mating protrusion 488-*p*. Mating protrusions 488-*p* and/or mating valleys 488-*v* may be configured to interface with mating protrusions and mating valleys of fixed mating surface 483. The interface (e.g., engagement) between the respective mating protrusions and mating valleys may enable movement to fixed positions and momentary positions, as discussed further herein.

In various embodiments, position indicator 460 may be similar to any other position indicator of a control interface disclosed herein. Position indicator 460 may be coaxial with one or more other components of control interface 400. Position indicator 460 may be configured to couple to translatable control 485 at a first end and left lever 452 at a second end. In that regard, operation of left lever 452 may cause movement of translatable control 485, via position indicator 460. Position indicator 460 may comprise a translatable shaft 461, an engagement end 462, and/or a cam 463.

In various embodiments, translatable shaft 461, engagement end 462, and/or cam 463 may comprise a single component. In various embodiments, translatable shaft 461 and engagement end 462 may comprise a single component and cam 463 may be coupled to an outer surface of the single component. In various embodiments, translatable shaft 461 may be coupled to a first end of cam 463 and engagement end 462 may be coupled to a second end of cam 463 opposite the first end.

In various embodiments, translatable shaft 461 may be coupled to orientation control 480. For example, translatable shaft 461 may be coupled to, and/or inserted within, translatable control 485. In response to a rotation of translatable control 485 (e.g., via right lever 451), translatable shaft 461 may cause rotation of position indicator 460.

In various embodiments, control interface 400 may include a bias spring 455. Bias spring 455 may be configured to provide axial force against one or more components in control interface 400. Bias spring 455 may be configured to provide axial force to maintain one or more components coaxially in control interface 400. Bias spring 455 may be located within a handle of a CEW, between right lever 451 and left lever 452. Bias spring 455 may be located between surface of stationary control 481 and position indicator 460. For example, bias spring 455 may be located between position indicator 460 and translatable control 485. Bias spring 455 may be configured to provide axial force against translatable control 485 and against position indicator 460. As a further example, in other embodiments, bias spring 455 may be positioned between position indicator 460 and fixed surface 482, and may be positioned at least partially within translatable control 485. Translatable shaft 461 may be inserted through bias spring 455 to couple to translatable control 485. Bias spring 455 may comprise any spring configured to provide axial force. For example, bias spring 455 may comprise a wave spring, a coil spring, and/or the like.

In various embodiments, engagement end 462 may be coupled to left lever 452. For example, engagement end 462 may be coupled to, and/or inserted within, left lever 452. In response to a rotation of left lever 452, engagement end 462 may cause rotation of position indicator 460.

In various embodiments, cam 463 may be configured to indicate a position of control interface 400. For example, cam 463 may be configured to rotate responsive to operation of right lever 541 and/or left lever 542. Cam 463 may be configured to rotated into one or more positions based on operation of right lever 541 and/or left lever 542 into a fixed position or a momentary position. For example, cam 463 may rotate into a first position in response to control interface 400 being in a first momentary position, a second position in response to control interface 400 being in a first fixed position, a third position in response to control interface 400 being in a second fixed position, a fourth position in response to control interface 400 being in a second momentary position, and/or the like.

In various embodiments, cam 463 may comprise an outer cam surface 464 defining a contact surface 465. Contact surface 465 may comprise a surface or material different from outer cam surface 464. In some embodiments, contact surface 465 may comprise a portion of outer cam surface 464 that is exposed relative to the rest of outer cam surface 464. For example, outer cam surface 464 may comprise a coating. Contact surface 465 may comprise a portion of outer cam surface 464 that does not comprise a coating. In some embodiments, outer cam surface 464 may comprise a first material and contact surface 465 may comprise a second material. The first material may be different, or comprise different properties, than the second material. For example, the first material may comprise a non-conductive material and the second material may comprise a conductive material.

In various embodiments, contact surface 465 may define one or more portions of outer cam surface 464. Each portion may comprise a different dimension. For example, each portion may comprise a different axial width. In that respect, a different portion of contact surface 465 may be exposed to (or engaged with) a position reader dependent on operation of control interface 400. For example, cam 463 may rotate into a first position in response to control interface 400 being in a first momentary position. In the first position, a first portion of contact surface 465 may be exposed to (or engaged with) a position reader. Cam 463 may rotate into a second position in response to control interface 400 being in a first fixed position. In the second position, a second portion of contact surface 465 may be exposed to (or engaged with) a position reader. Cam 463 may rotate into a third position in response to control interface 400 being in a second fixed position. In the third position, a third portion of contact surface 465 may be exposed to (or engaged with) a position reader. Cam 463 may rotate into a fourth position in response to control interface 400 being in a second momentary position. In the fourth position, a fourth portion of contact surface 465 may be exposed to (or engaged with) a position reader.

Figure 6A:
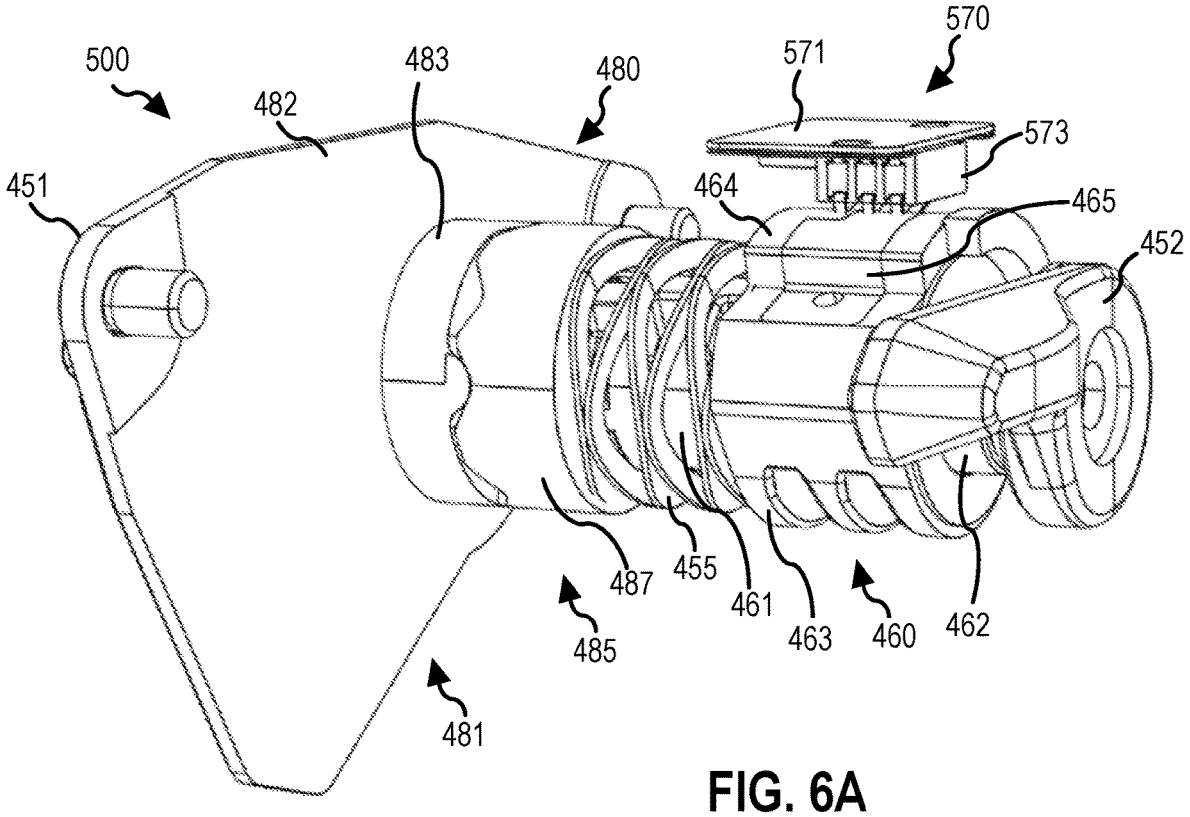
FIG. 6A is a perspective view of a control interface with a position reader, in accordance with various embodiments.
Figure 6B:
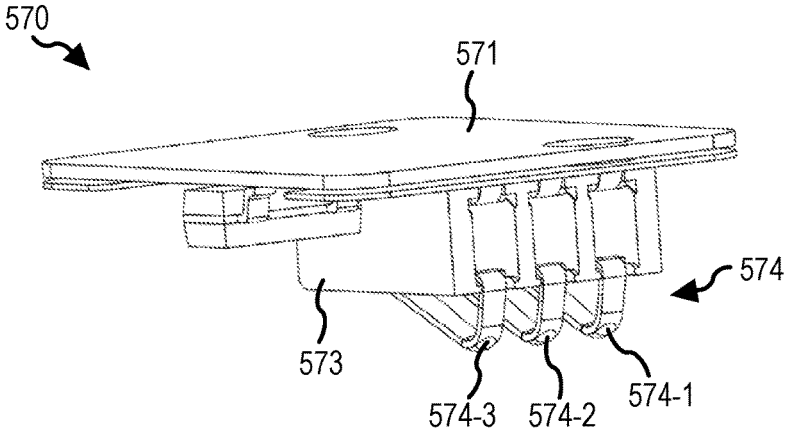
FIG. 6B is a perspective view of the position reader of FIG. 6A, in accordance with various embodiments.

In various embodiments, and with reference to FIGS. 6A and 6B, a control interface 500 may comprise, or be configured to interface with, a position reader 570. Control interface 500 may be similar to any other control interface disclosed herein. Position reader 570 may be similar to any other position reader disclosed herein. Position reader 570 may comprise one or more of a reader platform 571 and/or a reader interface 573.

In various embodiments, reader platform 571 may be configured to mount position reader 570 within a housing of a CEW. Reader platform 571 may be configured to mount position reader 570 within the housing proximate a position indicator (e.g., in a mount position where position reader 570 may interface with position indicator 460). In various embodiments, reader platform 571 may also comprise electrical or electronic components configured to enable electronic communications between position reader 571 and a processing circuit of the CEW.

In various embodiments, reader interface 573 may be coupled to reader platform 571 in a position where reader interface 573 may interface with (or engage) position indicator 460. Reader interface 573 may be configured to determine a position of control interface 500 by interfacing with position indicator 460. Reader interface 573 may be configured to determine the position using any suitable technique. Reader interface 573 may comprise one or more electrical, mechanical, and/or electronic components configured to at least partially aid in determining the position of control interface 500. In response to determining the position, position reader 570 may provide the position (or data regarding the position) to a processing circuit. The processing circuit may perform operations based on the position (or data regarding the position), as previously discussed.

For example, and in accordance with various embodiments, reader interface 573 may comprise one or more sensors 574 configured to interface with position indicator 460 to determine the position of control interface 500. The one or more sensors 574 may be configured to determine the position of control interface 500 using any suitable process.

The one or more sensors 574 may be configured to determine a position of control interface 500 using any suitable process or technique. For example, in some embodiments, the one or more sensors 574 may be configured to determine the position mechanically, such as by detecting a pressure of control interface 500 against the one or more sensors 574. In that regard, the pressure detected by the one or more sensors 574 may indicate a position of the control interface 500 (e.g., pressure against a first sensor indicates a first position, pressure against a first sensor and a second sensor indicates a second position, etc.). As a further example, in some embodiments, the one or more sensors 574 may be configured to determine the position electrically or electronically, such as by contacting an exposed conductive surface of control interface 500 to complete an electrical circuit. In that regard, completion of an electrical circuit and/or transmission or reception of electrical signals by the one or more sensors 574 may indicate a position of the control interface 500 (e.g., contact of a first sensor against a conductive surface indicates a first position, contact of a first sensor and a second sensor against a conductive surface indicates a second position, etc.). In some embodiments, a processing circuit may control or detect completion of an electrical circuit and/or transmission or reception of electrical signals to determine the position of the control interface 500, via the one or more sensors 574.

In various embodiments, sensors 574 may be configured to contact the contact surface 465 of position indicator 460 to determine the position of control interface 500. As previously discussed, operation of control interface 500 may rotate position indicator 460 to expose different portions of control surface 465 to position reader 570. Based on the portion of control surface 465 exposed and in contact with one or more sensors 574, position reader 570 may determine the position of control interface 500.

For example, and in accordance with various embodiments, sensors 574 may comprise a first sensor 574-1 (e.g., a GND sensor), a second sensor 574-2 (e.g., a SAFETY sensor), a third sensor 574-3 (e.g., an UP SAFETY sensor), and/or any other suitable or desired number of sensors. One or more of sensors 574 may be configured to contact the contact surface 465 based on the position of position indicator 460. Based on which sensors 574 are contacting the contact surface 465, position reader 570 (or the processing circuit) may determine the position of control interface 500.

For example, cam 463 may rotate into a first position in response to control interface 400 being in a first momentary position (e.g., a momentary up position). In the first position, a first portion of contact surface 465 may be exposed to (or engaged with) a position reader. In the first position, first sensor 574-1, second sensor 574-2, and third sensor 574-3 may engage (e.g., contact) contact surface 465, while no sensor 574 engages (e.g., contacts) outer cam surface 464. Cam 463 may rotate into a second position in response to control interface 400 being in a first fixed position (e.g., a safety off position). In the second position, a second portion of contact surface 465 may be exposed to (or engaged with) a position reader. In the second position, first sensor 574-1 may engage (e.g., contact) contact surface 465, while second sensor 574-2 and third sensor 574-3 engages (e.g., contacts) outer cam surface 464. Cam 463 may rotate into a third position in response to control interface 400 being in a second fixed position (e.g., a safety on position). In the third position, a third portion of contact surface 465 may be exposed to (or engaged with) a position reader. In the third position, first sensor 574-1 and second sensor 574-2 may engage (e.g., contact) contact surface 465, while third sensor 574-3 engages (e.g., contacts) outer cam surface 464. Cam 463 may rotate into a fourth position in response to control interface 400 being in a second momentary position (e.g., a momentary down position). In the fourth position, a fourth portion of contact surface 465 may be exposed to (or engaged with) a position reader. In the fourth position, first sensor 574-1 and third sensor 574-3 may engage (e.g., contact) contact surface 465, while second sensor 574-2 engages (e.g., contacts) outer cam surface 464.

In various embodiments, a conducted electrical weapon ("CEW") is disclosed. The CEW may comprise a deployment unit comprising an electrode; a control interface operable into a fixed position and a momentary position; and a processing circuit in electronic communication with the control interface. In response to the control interface being operated into the fixed position the processing circuit is configured to perform a firing mode operation to enable or disable deployment of the electrode from the deployment unit. In response to the control interface being operated into the momentary position the processing circuit is configured to perform a non-firing mode operation different from the firing mode operation.

In various embodiments, the non-firing mode operation comprises at least one of enabling a component, disabling a component, entering a training mode, entering a functional test mode, entering a virtual reality mode, or entering a stealth mode. In response to the non-firing mode operation comprising entering the training mode, entering the functional test mode, entering the virtual reality mode, or entering the stealth mode and in response to the control interface being operated into the momentary position during a second operation, the processing circuit is configured to perform a selection operation within the training mode, the functional test mode, the virtual reality mode, or the stealth mode.

In various embodiments, the fixed position comprises a first fixed position and a second fixed position, and the momentary position comprises a first momentary position and a second momentary position. In response to the control interface being operated into the first fixed position the processing circuit is configured to disable deployment of the electrode from the deployment unit, and in response to the control interface being operated into the second fixed position the processing circuit is configured to enable deployment of the electrode from the deployment unit.

In various embodiments, the control interface is configured to be operated into the first momentary position from the first fixed position, and in response to the control interface being operated into the first momentary position the control interface is configured to perform the non-firing mode operation while deployment of the electrode from the deployment unit remains disabled. In various embodiments, the control interface is configured to be operated into the second momentary position from the second fixed position, and wherein in response to the control interface being operated into the second momentary position the control interface is configured to perform the non-firing mode operation while deployment of the electrode from the deployment unit remains enabled.

In various embodiments, in response to the control interface being operated into the momentary position the control interface is configured to return to the fixed position. The processing circuit is configured to determine a time that the control interface is operated into the momentary position before returning to the fixed position, and the processing circuit is configured to perform the non-firing mode operation based on the time.

In various embodiments, the processing circuit is configured to determine a type of the deployment unit, and the processing circuit is configured to perform the non-firing mode operation based on the type of the deployment unit.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures. The scope of the disclosure is accordingly to be limited by nothing other than the appended claims and their legal equivalents, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B, and C may be present in a single embodiment; for example, A and B, A and C, B and C, or A and B and C.

Systems, methods and apparatus are provided herein. In the detailed description herein, references to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments. Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A control interface for a conducted electrical weapon comprising:

an interface; and an orientation control configured to enable the interface to move between a fixed position and a momentary position, wherein the momentary position is in a direction away from the fixed position, wherein in response to the interface being moved into the momentary position the orientation control is configured to return the interface to the fixed position, wherein a first force applied on to the interface causes the interface to move into the momentary position, wherein a second force provided by the orientation control to the interface causes the interface to return to the fixed position, and wherein the first force is a different type of force from the second force.

2. The control interface of claim 1, further comprising:

a position indicator configured to indicate that the interface is moved into the fixed position or the momentary position; and a position reader configured to interface with the position indicator to determine whether the interface is moved into the fixed position or the momentary position.

3. The control interface of claim 1, wherein the fixed position comprises a first fixed position and a second fixed position, wherein in response to the interface being moved into the first fixed position the orientation control is configured to maintain the interface in the first fixed position, and wherein in response to the interface being moved into the second fixed position the orientation control is configured to maintain the interface in the second fixed position.

4. The control interface of claim 1, wherein the momentary position comprises a first momentary position and a second momentary position, and wherein in response to the interface being moved into the first momentary position or the second momentary position the orientation control is configured to return the interface to the fixed position.

5. The control interface of claim 1, wherein the fixed position comprises a first fixed position and a second fixed position, and wherein the momentary position comprises a first momentary position and a second momentary position.

6. The control interface of claim 5, wherein in response to the interface being moved into the first momentary position the orientation control is configured to return the interface to the first fixed position.

7. The control interface of claim 5, wherein in response to the interface being moved into the second momentary position the orientation control is configured to return the interface to the second fixed position.

8. The control interface of claim 5, wherein the first momentary position comprises a momentary down position relative to the first fixed position, and wherein the second momentary position comprises a momentary up position relative to the second fixed position.

9. A conducted electrical weapon ("CEW") comprising:

a housing; and a control interface coupled to the housing, wherein the control interface comprises:

an interface; and an orientation control configured to enable the interface to operate into a fixed position and a momentary position, wherein in response to the interface being operated into the momentary position the orientation control is configured to return the interface to the fixed position, wherein a first force on the control interface causes the interface to operate into the momentary position, wherein a second force causes the interface to return to the fixed position, wherein the first force is different from the second force, wherein the first force is applied to the interface from an external source, and wherein the second force is applied to the interface from a component of the CEW.

10. The CEW of claim 9, wherein the momentary position comprises a first momentary position and a second momentary position, wherein the interface is operable from the fixed position into the first momentary position in a first direction, wherein the interface is operable from the fixed position into the second momentary position in a second direction, and wherein the first direction is different from the second direction.

11. The CEW of claim 9, further comprising:

a position indicator coupled to the orientation control, wherein the position indicator is configured to indicate that the interface is operated into the fixed position or the momentary position; and a position reader configured to interface with the position indicator to determine whether the interface is operated into the fixed position or the momentary position.

12. The CEW of claim 11, wherein each of the interface, the orientation control, and the position indicator are coaxial.

13. The CEW of claim 9, wherein the orientation control comprises a stationary control and a translatable control, wherein a rotation of the interface rotates the translatable control, and wherein rotation of the translatable control causes the translatable control to engage with the stationary control to allow the interface to operate between the fixed position and the momentary position.

14. The CEW of claim 11, wherein the position indicator comprises an outer cam surface defining a contact surface having a first portion and a second portion, wherein a first rotation of the interface to the fixed position exposes the position reader to the first portion of the contact surface of the outer cam surface, and wherein a second rotation of the interface to the momentary position exposes the position reader to the second portion of the contact surface of the outer cam surface.

15. The CEW of claim 14, wherein the position reader comprises a sensor configured to interface with the contact surface of the outer cam surface to determine whether the interface is operated into the fixed position or the momentary position.

16. The CEW of claim 15, wherein the contact surface comprises an exposed conductive surface, and wherein the sensor electrically engages the contact surface to determine whether the interface is operated into the fixed position or the momentary position.

17. The control interface of claim 4, wherein the first momentary position is in a first direction away from the fixed position, wherein the second momentary position is in a second direction away from the fixed position, and wherein the first direction is different from the second direction.

18. The control interface of claim 1, wherein the interface comprises a lever and wherein the second force comprises a biasing force.

19. The CEW of claim 9, wherein the interface is located external the housing, and wherein the orientation control is located internal the housing.

20. The CEW of claim 9, wherein the interface comprises a lever and wherein the second force comprises a biasing force.

* * * * *